US010118385B2

(12) United States Patent
Umeda

(10) Patent No.: US 10,118,385 B2
(45) Date of Patent: Nov. 6, 2018

(54) PRINTING ELEMENT SUBSTRATE, PRINTHEAD, AND PRINTING APPARATUS

(71) Applicant: CANON KABUSHIKI KAISHA, Tokyo (JP)

(72) Inventor: Kengo Umeda, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/695,514

(22) Filed: Sep. 5, 2017

(65) Prior Publication Data

US 2018/0086057 A1 Mar. 29, 2018

(30) Foreign Application Priority Data

Sep. 28, 2016 (JP) ..... 2016-189918

(51) Int. Cl.
*B41J 2/045* (2006.01)

(52) U.S. Cl.
CPC ..... *B41J 2/04563* (2013.01); *B41J 2/04508* (2013.01); *B41J 2/04573* (2013.01); *B41J 2/04541* (2013.01)

(58) Field of Classification Search
CPC ..... B41J 2/04508; B41J 2/04541; B41J 2/04563; B41J 2/04573; B41J 2/04501; B41J 29/393; B41J 29/38; B41J 2/045
See application file for complete search history.

(56) References Cited

U.S. PATENT DOCUMENTS 9,073,076 B2 * 7/2015 Oshima ..... B41J 2/04541
9,272,508 B2 3/2016 Umeda et al.
9,488,501 B2 * 11/2016 Ito ..... G01D 5/24471
9,688,067 B2 6/2017 Umeda et al.

FOREIGN PATENT DOCUMENTS

WO 2012/102709 A1 8/2012

OTHER PUBLICATIONS

U.S. Appl. No. 15/590,489, filed May 9, 2017.

* cited by examiner

*Primary Examiner* — Jannelle M Lebron
(74) *Attorney, Agent, or Firm* — Fitzpatrick, Cella, Harper & Scinto

(57) ABSTRACT

A printing element substrate comprises a correction circuit that corrects a phase difference between a first signal and a second signal, wherein the correction circuit includes a first delay circuit that generates a plurality of first delayed signals having different delay times with respect to the first signal, and a second delay circuit that generates a plurality of second delayed signals having different delay times with respect to the second signal, the correction circuit specifies a phase of the first signal to be output to the driving circuit, on the basis of comparison between the plurality of first delayed signals and the second signal, and the correction circuit specifies a phase of the second signal to be output to the driving circuit, on the basis of comparison between the plurality of second delayed signals and the first signal having the specified phase.

12 Claims, 14 Drawing Sheets

PRINTING ELEMENT SUBSTRATE, PRINTHEAD, AND PRINTING APPARATUS

BACKGROUND OF THE INVENTION

Field of the Invention

The present invention relates to printing element substrates, printheads, and printing apparatuses.

Description of the Related Art

A printing element substrate in an inkjet printing apparatus, which includes a semiconductor integrated circuit, receives a clock signal (CLK) and an image data signal (DATA) from the main body of the printing apparatus, and performs a printing operation on the basis of the image data. A recent increase in printing speed has been accompanied by clock signals and image data signals having a frequency of as high as several hundreds of megahertz. A phase difference occurs between a clock signal and an image data signal due to variations in a transmitter circuit and a receiver circuit. A clock signal and an image data signal that have a higher frequency are more likely to be significantly affected by the phase difference. Therefore, it is more difficult to synchronize such a clock signal and data signal with each other. Therefore, it is necessary to provide a means for correcting the phase difference between a clock signal and a data signal.

As a disclosed technique of correcting the phase difference between a clock signal and a data signal, a delay-locked loop (DLL) circuit or a phase-locked loop (PLL) circuit is provided in a receiver circuit, for example. International Publication No. 2012/102709 discloses an inkjet printing apparatus in which the phase difference between a clock signal and a data signal is corrected in a transmitter circuit. In the inkjet printing apparatus disclosed in International Publication No. 2012/102709, a control IC that is provided in the main body (including the transmitter circuit) of the printing apparatus repeatedly reads image data signals received by a printing element substrate (in a receiver circuit), and checks the reception results, to determine an optimum phase correction amount.

In conventional techniques employing a delay-locked loop (DLL) circuit or a phase-locked loop (PLL) circuit, a training period for stabilizing the operation of DLL or PLL is required. In the technique disclosed in International Publication No. 2012/102709, it is necessary to check the result of reception performed by the printing element substrate a plurality of times in order to perform phase correction one time, and therefore, it takes a long time to determine the phase correction amount. Therefore, it is difficult to perform phase correction on a regular basis, and it is difficult to follow changes in phase caused by changes in temperature or changes over time.

SUMMARY OF THE INVENTION

With the above problems in mind, the present invention has been made. It is an object of the present invention to provide a highly reliable printing apparatus that includes a phase correction unit capable of following phase changes caused by changes in temperature or changes over time, without the need of a training period for stabilizing the operation.

According to one aspect of the present invention, there is provided a printing element substrate comprising: a printing element; a driving circuit configured to drive the printing element; a receiver circuit configured to receive a first signal and a second signal; and a correction circuit configured to correct a phase difference between the first signal and the second signal received by the receiver circuit, and output the corrected first and second signals to the driving circuit, wherein the correction circuit includes a first delay circuit configured to generate a plurality of first delayed signals having different delay times with respect to the first signal, and a second delay circuit configured to generate a plurality of second delayed signals having different delay times with respect to the second signal, the correction circuit specifies a phase of the first signal to be output to the driving circuit, on the basis of comparison between the plurality of first delayed signals and the second signal, and the correction circuit specifies a phase of the second signal to be output to the driving circuit, on the basis of comparison between the plurality of second delayed signals and the first signal having the specified phase.

According to another aspect of the present invention, there is provided a printhead comprising: a plurality of printing element substrates, wherein each printing element substrate includes a printing element, a driving circuit configured to drive the printing element, a receiver circuit configured to receive a first signal and a second signal, and a correction circuit configured to correct a phase difference between the first signal and the second signal received by the receiver circuit, and output the corrected first and second signals to the driving circuit, the correction circuit includes a first delay circuit configured to generate a plurality of first delayed signals having different delay times with respect to the first signal, and a second delay circuit configured to generate a plurality of second delayed signals having different delay times with respect to the second signal, the correction circuit specifies a phase of the first signal to be output to the driving circuit, on the basis of comparison between the plurality of first delayed signals and the second signal, and the correction circuit specifies a phase of the second signal to be output to the driving circuit, on the basis of comparison between the plurality of second delayed signals and the first signal having the specified phase.

According to another aspect of the present invention, there is provided a printing apparatus comprising: a printhead including a plurality of printing element substrates, wherein each printing element substrate includes a printing element, a driving circuit configured to drive the printing element, a receiver circuit configured to receive a first signal and a second signal, and a correction circuit configured to correct a phase difference between the first signal and the second signal received by the receiver circuit, and output the corrected first and second signals to the driving circuit, the correction circuit includes a first delay circuit configured to generate a plurality of first delayed signals having different delay times with respect to the first signal, and a second delay circuit configured to generate a plurality of second delayed signals having different delay times with respect to the second signal, the correction circuit specifies a phase of the first signal to be output to the driving circuit, on the basis of comparison between the plurality of first delayed signals and the second signal, and the correction circuit specifies a phase of the second signal to be output to the driving circuit, on the basis of comparison between the plurality of second delayed signals and the first signal having the specified phase.

According to the present invention, a phase difference can be instantaneously corrected without the need of a training period. Therefore, a highly reliable printing apparatus can be provided in which phase changes caused by changes in temperature or changes over time can be followed.

Further features of the present invention will become apparent from the following description of exemplary embodiments (with reference to the attached drawings).

DESCRIPTION OF THE EMBODIMENTS

Figure 1:
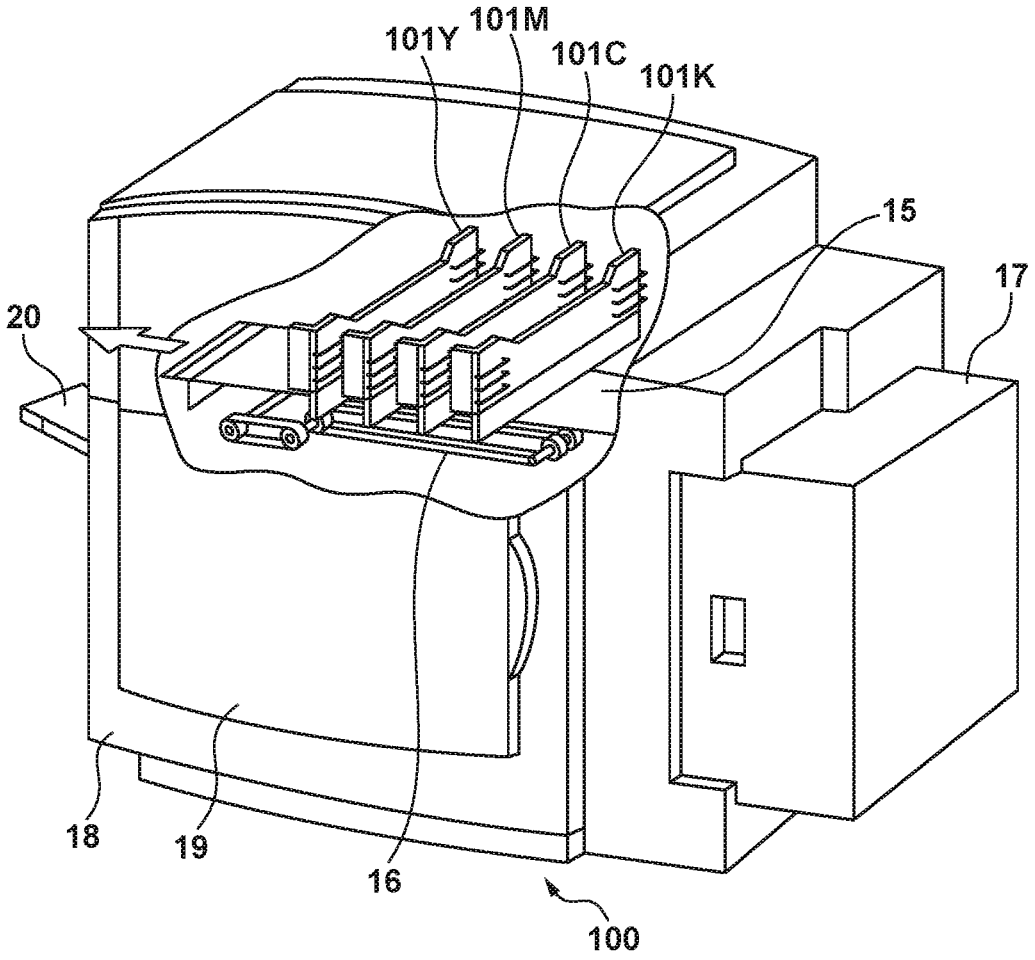
FIG. 1 is an external perspective view showing an example configuration of an inkjet printing apparatus.

Preferred embodiments of the present invention will be described more specifically and in greater detail with reference to the accompanying drawings. Note that the relative arrangements of components, etc., described in examples are not intended to limit the scope of the present invention unless otherwise specified.

As used herein, the term "print" refers to not only formation of information having a meaning such as characters, graphics, etc., but also formation of meaningless information. Furthermore, the term "print" refers to formation of an image, a picture, a pattern, etc., on a printing medium, or processing of a printing medium, in a broad sense, irrespective of whether such information may or may not be made manifest and recognizable to the human eye.

As used herein, the term "printing medium" refers to not only paper that is used for typical printing apparatuses, but also a wide variety of materials that can receive ink, such as cloth, plastic film, metal sheets, glass, ceramics, wood, leather, etc.

As used herein, the term "ink" (may be interchangeable with the term "liquid") should be interpreted in a broad sense as with the term "print." Therefore, as used herein, the term "ink" refers to liquid that when applied to a printing medium can form an image, a picture, a pattern, etc., process the printing medium, or process itself (e.g., coagulation or insolubilization of a colorant in the ink applied to the printing medium).

As used herein, the term "printing element" refers to a set of a discharge opening, a liquid path that is coupled to and in communication with the discharge opening, and an element for generating energy to be utilized for discharging ink, unless otherwise specified.

As used herein, the term "nozzle" refers to a set of a discharge opening, a liquid path that is coupled to and in communication with the discharge opening, and an element for generating energy to be utilized for discharging ink, unless otherwise specified.

As used herein, the term "element substrate (head substrate)" with respect to a printhead refers to a substrate on which elements, interconnects, etc., are provided, but not a merely substrate of silicon semiconductor.

As used herein, the term "on" with respect to a substrate refers to not only a situation that an element is above the element substrate, but also situations that an element touches a surface of the element substrate or is partially or entirely inside the element substrate in the vicinity of a surface thereof. As used herein, the term "built-in" refers to a situation that elements are integrally formed or manufactured on an element substrate by a semiconductor circuit manufacturing process, etc., but not a situation that separate elements are merely disposed on a surface of a separate substrate.

An inkjet printhead (hereinafter referred to as a "printhead") that is a most important characteristic feature of the present invention includes an element substrate, and a plurality of printing elements and a driving circuit for driving these printing elements, which are each implemented on the element substrate. As can be seen from the description that follows, the printhead includes a plurality of element substrates, and has a structure in which these element substrates are connected together in cascade. Therefore, the printhead can achieve a relatively long print width. Therefore, the printhead is applicable to not only typical serial printing apparatuses, but also printing apparatuses equipped with a full-line printhead having a print width corresponding to the width of a printing medium. Of serial printing apparatuses, the printhead is especially applicable to large-format printers for printing media having a large size, such as A0, B0, etc.

Therefore, firstly, a printing apparatus in which the printhead of the present invention is used will be described.

(Overview of Printing Apparatus)

FIG. 1 is a perspective diagram for describing a structure of a printing apparatus 100 including full-line inkjet printheads (hereinafter referred to as "printheads") 101K, 101C, 101M, and 101Y, and a recovery unit for guaranteeing consistently stable ink discharge.

In the printing apparatus 100, printing paper 15 is supplied from a feeder unit 17 to respective printing positions of the printheads, and is conveyed by a conveyance unit 16 included in a housing 18 of the printing apparatus.

An image is printed onto the printing paper 15 as follows. When the printing paper 15 is conveyed, so that a reference position of the printing paper 15 arrives below the printhead 101K which discharges black (K) ink, the printhead 101K discharges black ink. Similarly, the printhead 101C which discharges cyan (C) ink, the printhead 101M which discharges magenta (M) ink, and the printhead 101Y which discharges yellow (Y) ink, discharge ink of respective colors in this order when the printing paper 15 arrives at the respective reference positions, so that a color image is formed. The printing paper 15, on which an image has thus been printed, is exited and stacked on a stacker tray 20.

The printing apparatus 100 further includes the conveyance unit 16, and ink cartridges (not shown) for supplying ink to the printheads 101K, 101C, 101M, and 101Y. The ink cartridges can each be separately replaced for the respective ink. The printing apparatus 100 also further includes pump units (not shown) for supplying ink to the respective printheads 101 and performing respective recovery operations, a control substrate (not shown) for controlling the entire printing apparatus 100, etc. A front door 19 is opened or closed when an ink cartridge is replaced.

(Control Configuration)

Next, a control configuration for executing print control performed by the printing apparatus described with reference to FIG. 1.

Figure 2:
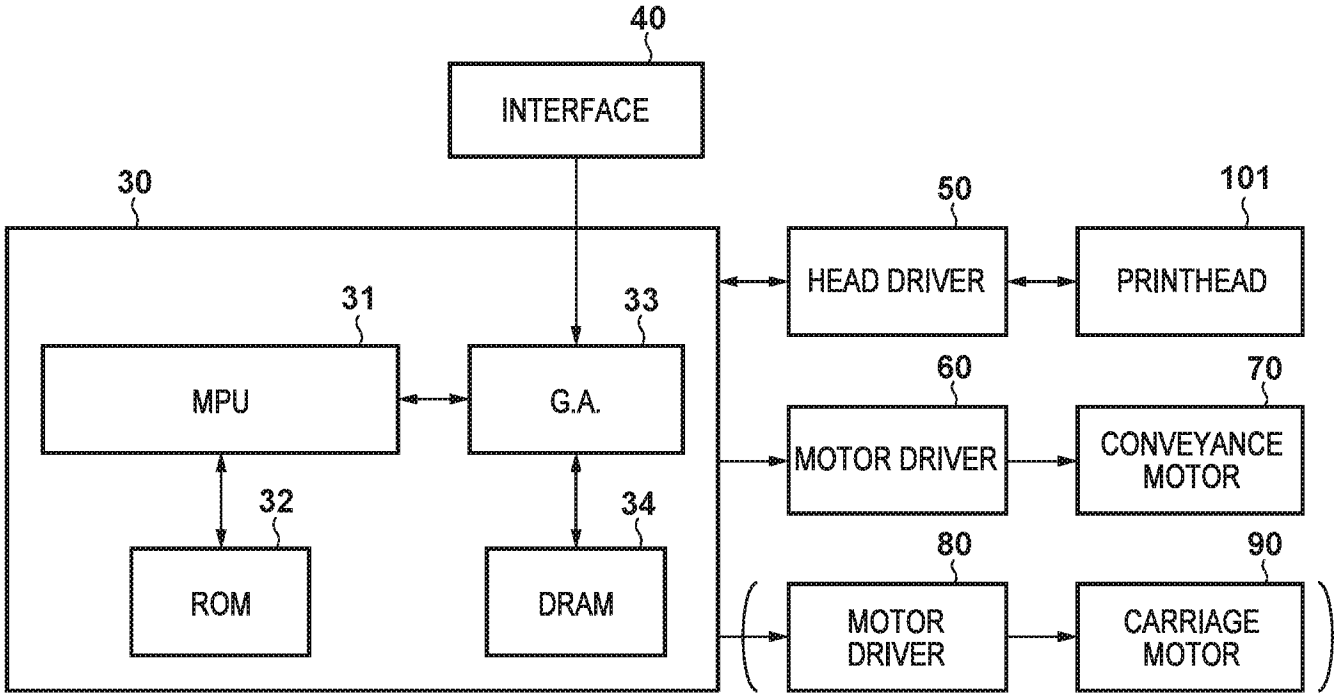
FIG. 2 is a diagram showing an example control configuration of an inkjet printing apparatus according to the present invention.

FIG. 2 is a block diagram showing a configuration of a control circuit in the printing apparatus. In FIG. 2, a controller 30 includes an MPU 31, a ROM 32, a gate array (G.A.) 33, and a DRAM 34. An interface 40 is used to input print data. The ROM 32, which is a non-volatile storage area, stores a control program that is executed by the MPU 31. The DRAM 34 is used to temporarily store print data, or data such as print signals supplied to printheads 101, etc. The gate array 33 controls supply of print signals to the printheads 101, and also controls data transfer between the interface 40, the MPU 31, and the DRAM 34. A carriage motor 90 conveys the printheads 101 (101K, 101C, 101M, and 101Y). A conveyance motor 70 conveys printing paper. A head driver 50 drives the printheads 101. Motor drivers 60 and 80 drive the conveyance motor 70 and the carriage motor 90, respectively.

Note that when the printing apparatus includes a full-line printhead as shown in FIG. 1, the printing apparatus does not include the carriage motor 90 or the motor driver 80 for driving the motor. Therefore, in FIG. 2, the carriage motor 90 and the motor driver 80 are shown in parentheses.

An operation of the control configuration will be described. When print data is input to the interface 40, the print data is converted into print signals for printing by the gate array 33 and the MPU 31. Thereafter, the motor drivers 60 and 80 are driven, and the printheads 101 are driven on the basis of print data sent to the head driver 50, to perform printing.

Although, in an example described below, a full-line printhead will be described as an example, the present invention is not limited to this. The present invention may be applied to a printhead included in a serial printing apparatus as described above. In this case, the printhead is mounted on a carriage, and performs reciprocal movements in the width direction of a printing medium to perform a printing operation.

Figure 14:
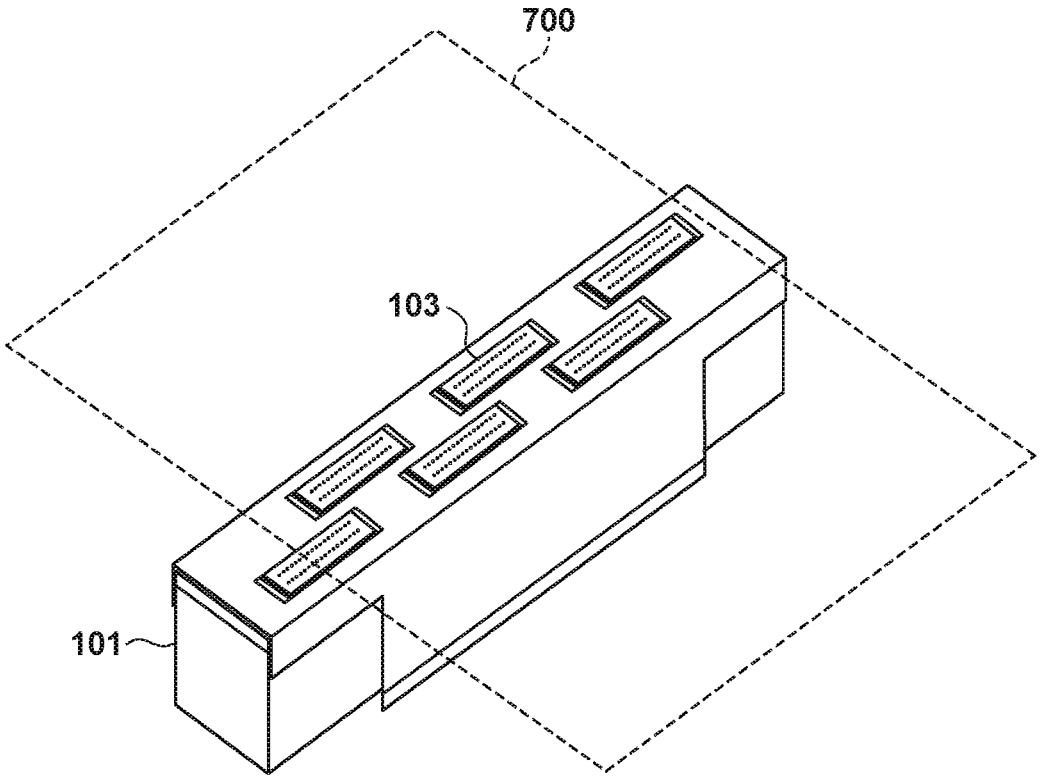
FIG. 14 is a perspective view of a printhead according to the present invention.

FIG. 14 is a perspective view of the printhead 101. As shown in FIG. 14, the full-line printhead includes a plurality of printing element substrates 103, and has a print width that is greater than or equal to the width of a printing medium 700, such as paper, etc. Although, in the example of FIG. 14, the printing element substrates 103 are arranged in a staggered pattern, the present invention is not limited to this. Alternatively, the printing element substrates 103 may be arranged in a straight line. Although, in FIG. 14, each printing element substrate 103 has a rectangular shape, the present invention is not limited to this. Alternatively, for example, each printing element substrate 103 may have a trapezoidal or parallelogrammatic shape.

Although, in the description that follows, attention is focused on a single printhead 101, the present invention is applicable to a printing apparatus including a plurality of printheads 101 as shown in FIG. 1.

First Embodiment

Figure 3:
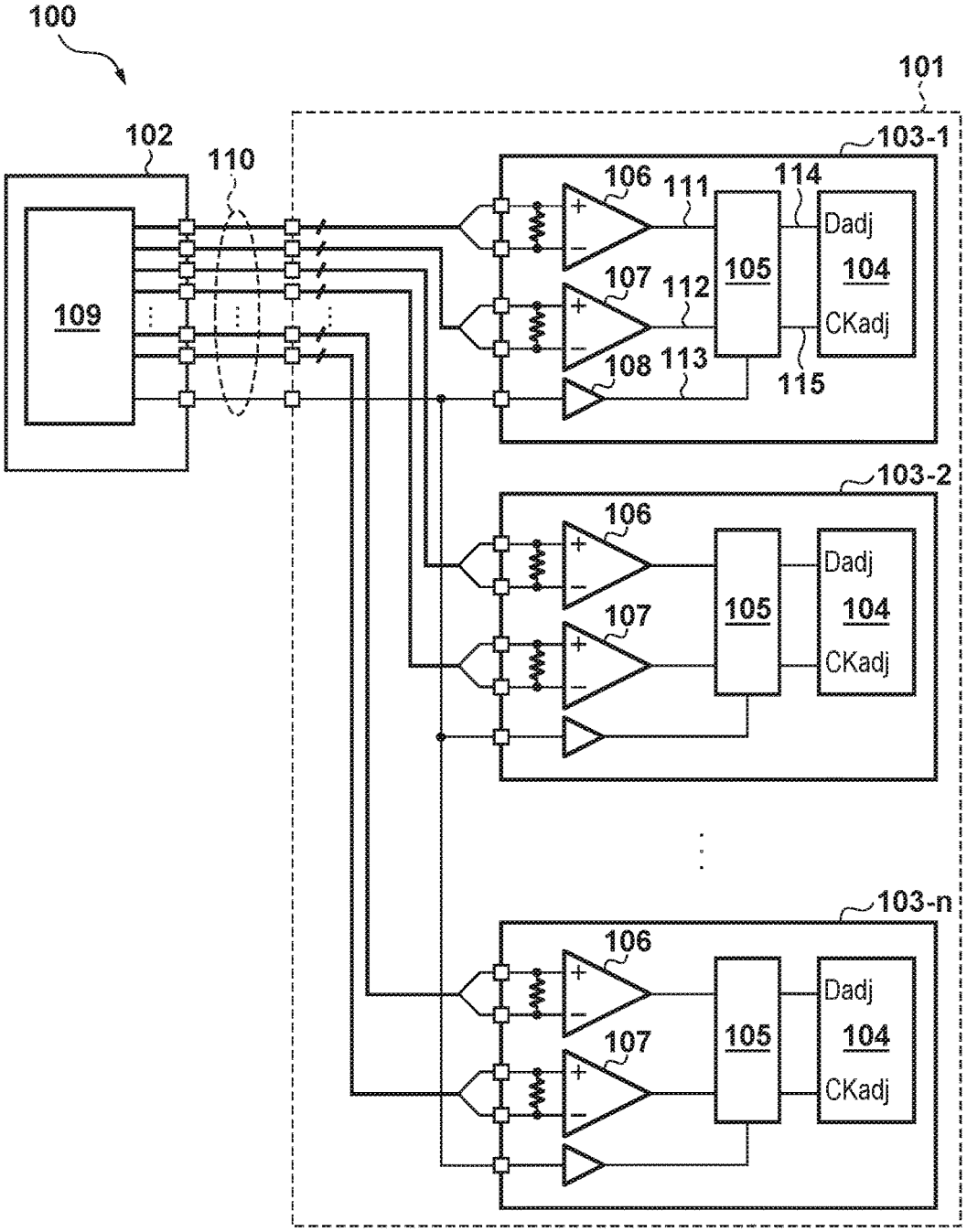
FIG. 3 is a diagram showing an example configuration of a printing apparatus according to a first embodiment.

FIG. 3 is a diagram schematically showing a printing apparatus 100 according to a first embodiment of the present invention. FIG. 3 shows an example of the full-line printhead 101. The same parts are hereinafter designated by the same reference characters. If the same parts need to be identified separately, these parts are designated by the same reference characters with different symbols affixed thereto. In this embodiment, the printhead 101, which includes a plurality of printing element substrates 103 (103-1 to 103-n), is coupled to a main-body substrate 102 of the printing apparatus through a transmission line path 110.

The printing element substrates 103 each include a first receiver circuit 106 for receiving a first signal 111 (DATA), a second receiver circuit 107 for receiving a second signal 112 (CLK), and a third receiver circuit 108 for receiving a third signal 113. The printing element substrates 103 also each include a correction circuit 105, and a driving circuit 104. Note that a printing element (not shown) is provided, corresponding to the driving circuit 104. A head control IC 109 generates the first signal 111, the second signal 112, and the third signal 113. The first signal 111, the second signal 112, and the third signal 113 are supplied from the head control IC 109 provided on the main-body substrate 102 of the printing apparatus to each printing element substrate 103 through the transmission line path 110.

The first signal 111, the second signal 112, and the third signal 113 are input to the correction circuit 105. The correction circuit 105 corrects a phase difference between the first signal 111 (DATA) and the second signal 112 (CLK) for each period of the third signal 113, to output a fourth signal 114 (Dadj) and a fifth signal 115 (CKadj). The fourth signal 114 (Dadj) is the first signal 111 (DATA) that has a corrected phase. The fifth signal 115 (CKadj) is the second signal 112 (CLK) that has a corrected phase. The fourth signal 114 (Dadj) and the fifth signal 115 (CKadj), which are output from the correction circuit 105, are input to the driving circuit 104. The driving circuit 104 is driven on the basis of the fourth signal 114 (Dadj) and the fifth signal 115 (CKadj), which have a corrected phase difference, and therefore, can reliably synchronize an image data signal with a clock signal, and thereby receive accurate image data.

Figure 4:
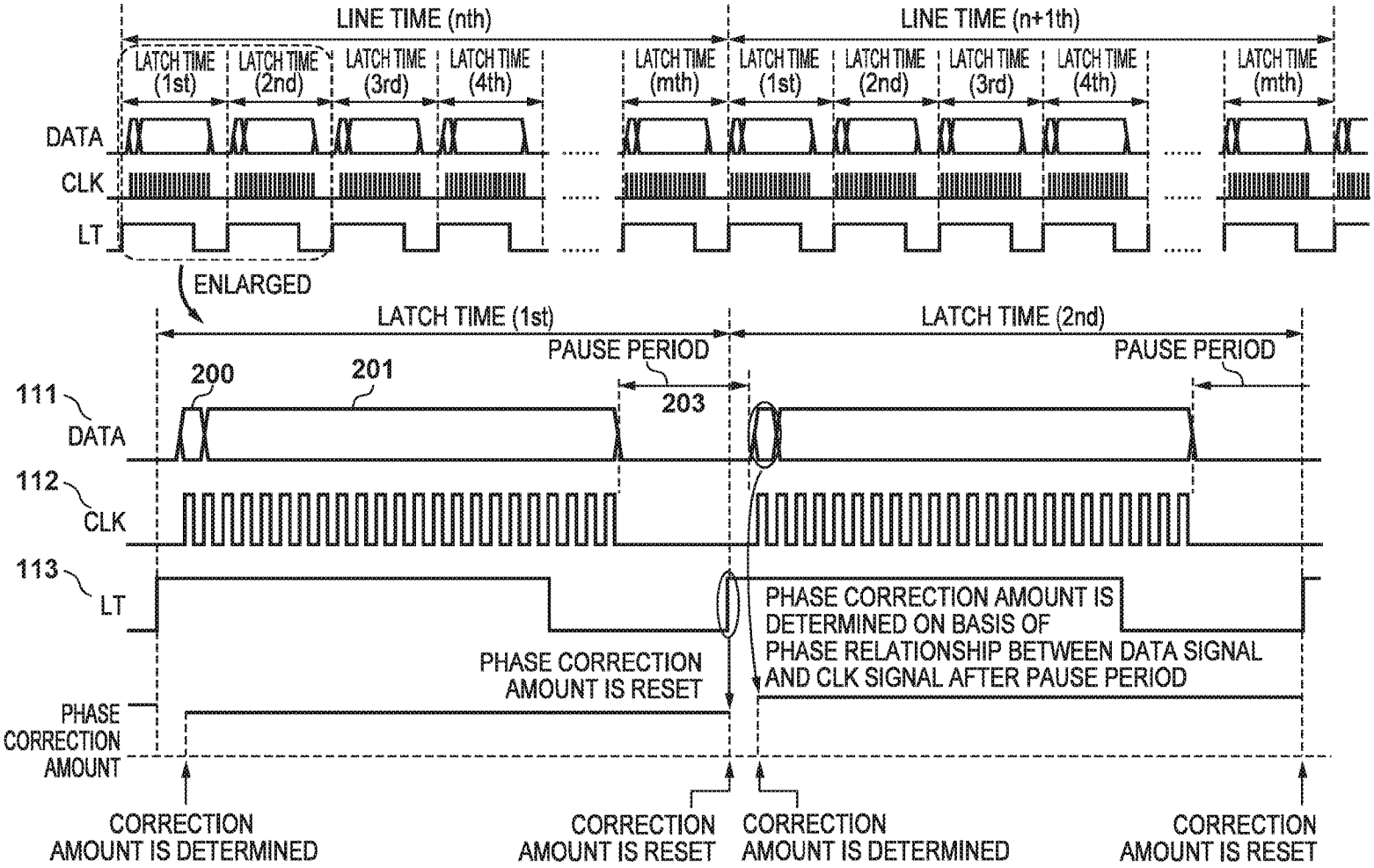
FIG. 4 is a timing chart of the printing apparatus according to the first embodiment.

FIG. 4 is a timing chart of the printing apparatus 100 according to the first embodiment of the present invention. In the description that follows, it is assumed that the first signal 111 is an image data signal (DATA), the second signal 112 is a clock signal (CLK), and the third signal 113 is a latch signal (LT). As used herein, the term "line time" refers to a period of time it takes to print a column or row of an image on a printing medium. The printing element substrates 103 divide one line time into a predetermined number of blocks, and successively drive printing elements (not shown) in a time-division manner. As used herein, the term "latch time" refers to a period of time corresponding to a block. A latch signal (LT) is used to identify one block. In the example of FIG. 4, one line time is divided into m latch times (i.e., m blocks). One latch time includes a period of time during which a test flag signal 200 is transmitted, a period of time during which an image data signal 201 is transmitted, and a pause period 203. During the pause period 203, neither the logic of an image data signal (DATA) nor the logic of a clock signal (CLK) transitions. In this embodiment, it is assumed that each latch time includes a pause period.

The printing apparatus 100 determines the amount of correction of a phase difference between an image data signal (DATA) and a clock signal (CLK) during a period of time that the test flag signal 200 is transmitted after the pause period 203, and corrects the phase difference on the basis of the determined correction amount. Specifically, a phase difference between the test flag signal 200 transmitted after the pause period 203, and a clock signal (CLK), is obtained, and an optimum phase correction amount is determined on the basis of a phase relationship between these signals. The phase correction amount thus determined is maintained during all the time that the image data signal 201 is transmitted, and is reset at the timing of a rising of a latch signal (LT). Such an operation is repeated for each latch time. As a result, the printing apparatus 100 according to the first embodiment can follow phase changes caused by changes in temperature or changes over time, and therefore, reliability is ensured.

Figure 5:
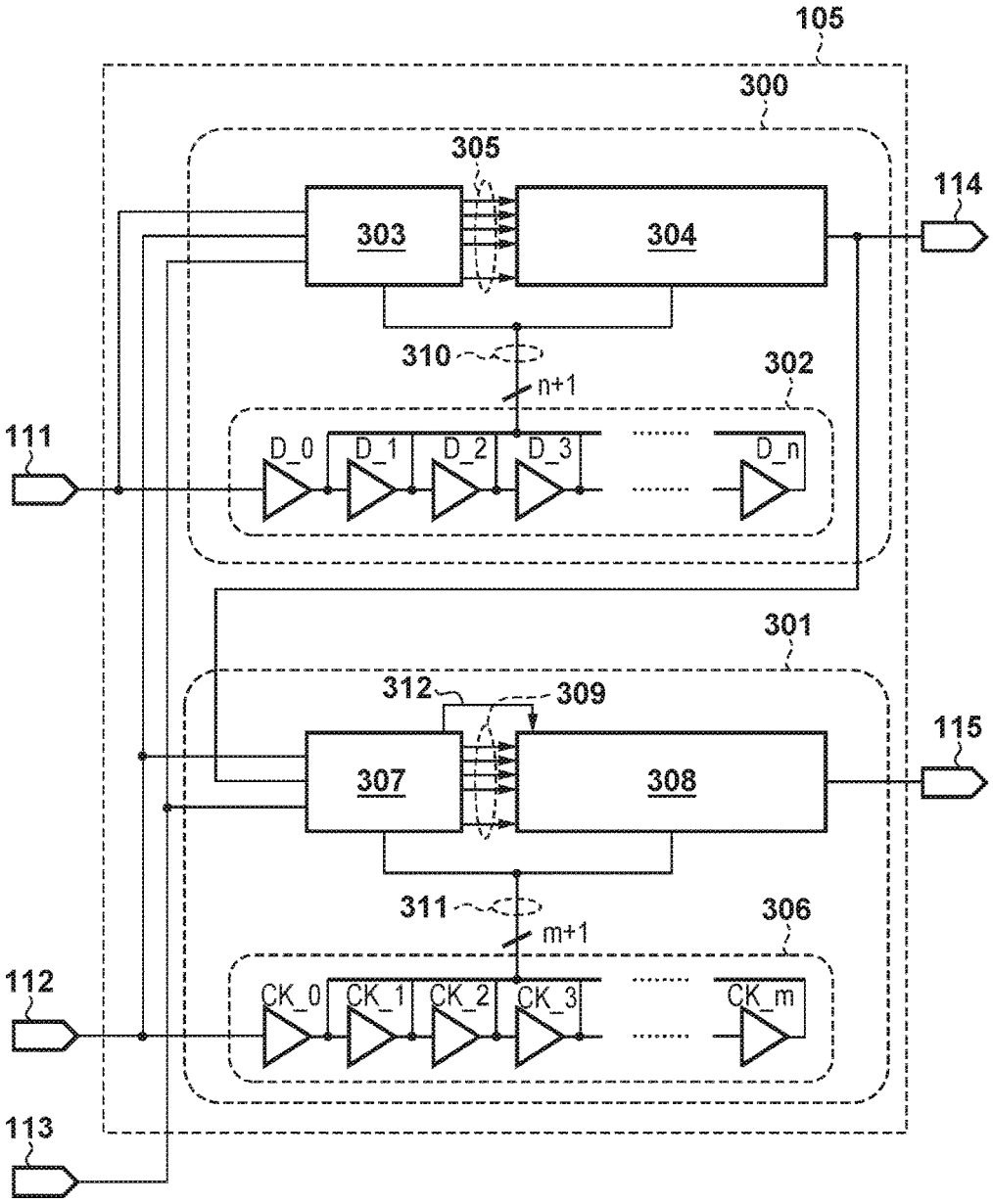
FIG. 5 is a block diagram showing an example configuration of a correction circuit according to the present invention.

FIG. 5 is a block diagram showing an example configuration of the correction circuit 105 in the printing apparatus 100 according to the first embodiment. The correction circuit 105 includes a first signal correction circuit 300 for correcting the phase of the first signal 111 (DATA), and a second signal correction circuit 301 for correcting the phase of the second signal 112 (CLK). The first signal correction circuit 300 includes a first delay circuit 302, a first determination circuit 303, and a first multiplexer 304. The first signal correction circuit 300 receives the first signal 111 (DATA), the second signal 112 (CLK), and the third signal 113 (LT). The second signal correction circuit 301 includes a second delay circuit 306, a second determination circuit 307, and a second multiplexer 308. The second signal correction circuit 301 receives the second signal 112 (CLK), the third signal 113 (LT), and the output (the fourth signal 114 (Dadj)) of the first signal correction circuit 300.

An operation of the correction circuit 105 will now be described with reference to FIG. 5. The first delay circuit 302 generates (n +1) first delayed signals 310 (D_0, D_1, D_2, . . . , and D_n) by delaying the first signal 111 (DATA). The first determination circuit 303 compares the phases of the first delayed signals 310 with the phase of the second signal 112 (CLK). The first determination circuit 303 determines which of the first delayed signals 310 (D_0, D_1, D_2, . . . , and D_n) has a rising edge that coincides with a rising edge of the second signal 112 (CLK), and outputs a first determination signal 305. The first multiplexer 304 selects the delayed signal having the coincidence edge determined by the first determination circuit 303, from the first delayed signals 310, on the basis of the first determination signal 305 output from the first determination circuit 303, and outputs that delayed signal as the fourth signal 114 (Dadj). In other words, the first multiplexer 304 is a selection circuit for selecting a signal to be output from the first delayed signals 310.

The second delay circuit 306 generates (m+1) second delayed signals 311 (CK_0, CK_1, CK_2, . . . , and CK_m) by delaying the second signal 112 (CLK). The second determination circuit 307 compares the phases of the second delayed signals 311 with the phase of the fourth signal 114. The second determination circuit 307 determines which of the second delayed signals 311 (CK_0, CK_1, CK_2, . . . , and CK_m) has a rising edge that coincides with a falling edge of the fourth signal 114 (Dadj), and outputs a second determination signal 309. The second multiplexer 308 selects, from the second delayed signals 311, a delayed signal having a delay time that is half the delay time of the delayed signal having the coincidence edge determined by the second determination circuit 307, on the basis of the second determination signal 309 output from the second determination circuit 307. In other words, the second multiplexer 308 is a selection circuit for selecting a signal to be output from the second delayed signals 311. Note that the second multiplexer 308 may select, for example, a second delayed signal that has a delay time that is smaller than the delay time of the delayed signal having the coincidence edge determined by the second determination circuit 307. Thereafter, the second multiplexer 308 outputs the selected second delayed signal 311 as the fifth signal 115 (CKadj).

Figure 6:
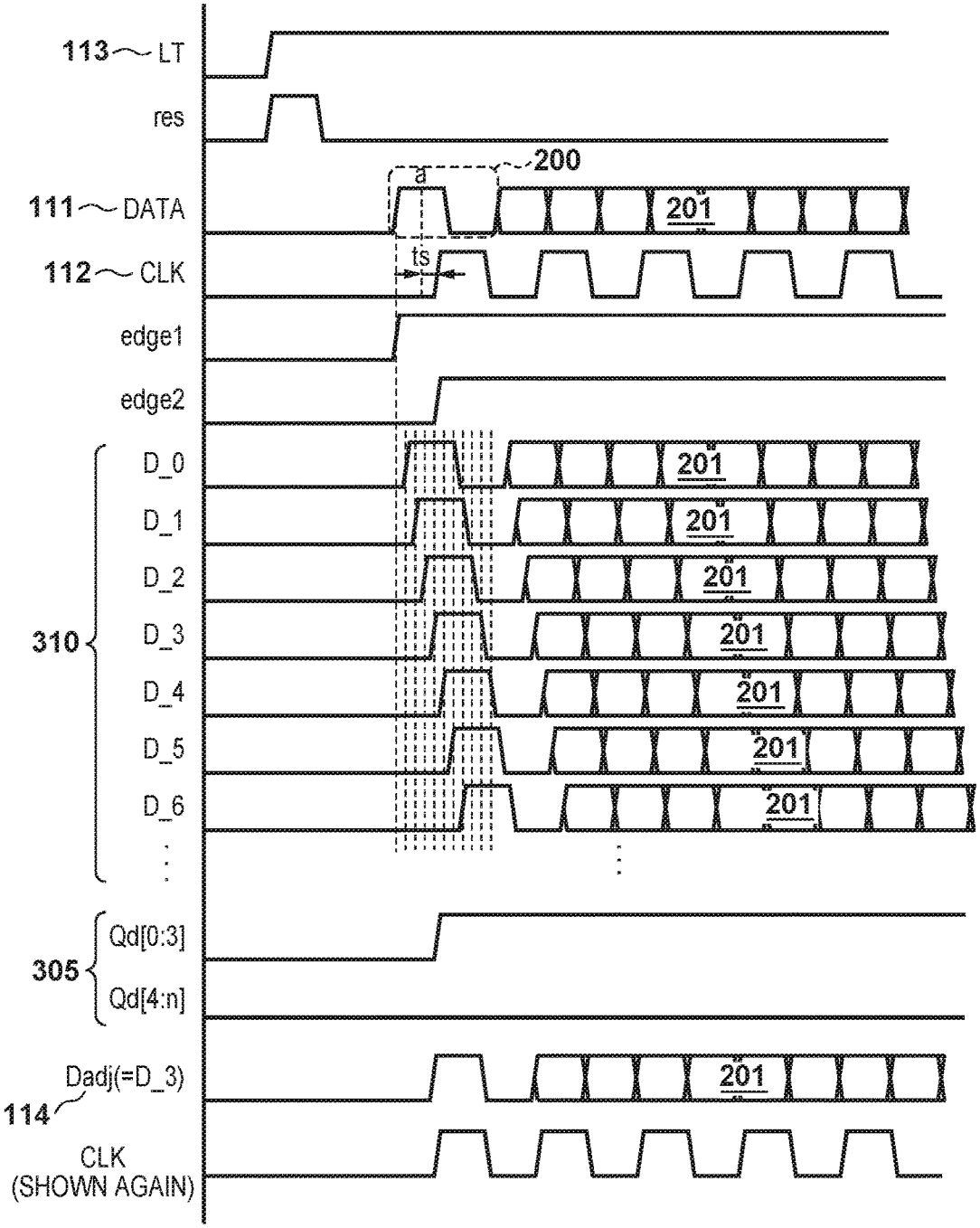
FIG. 6 is a timing chart of a first signal correction circuit according to the present invention.
Figure 7:
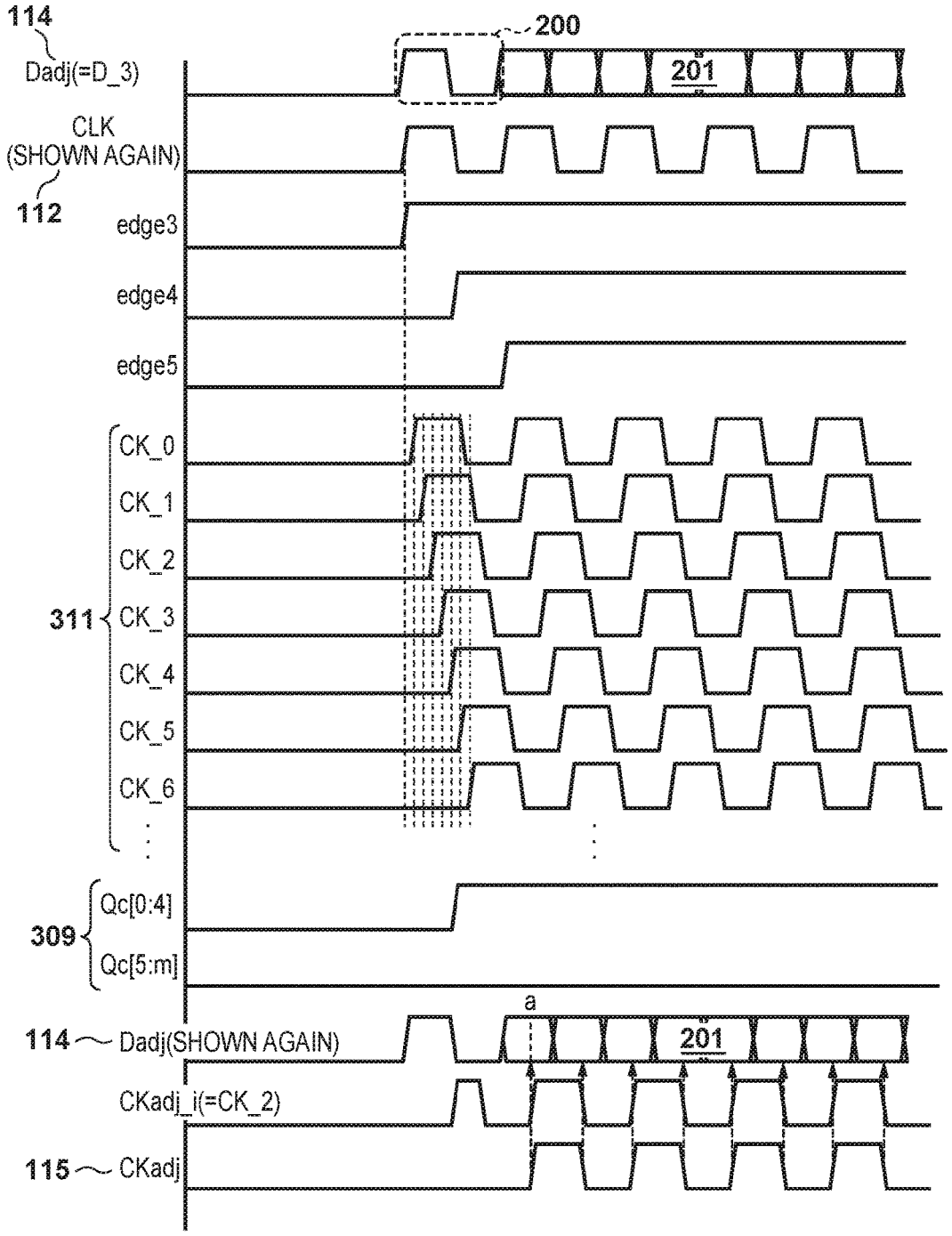
FIG. 7 is a timing chart of a second signal correction circuit according to the present invention.
Figure 8:
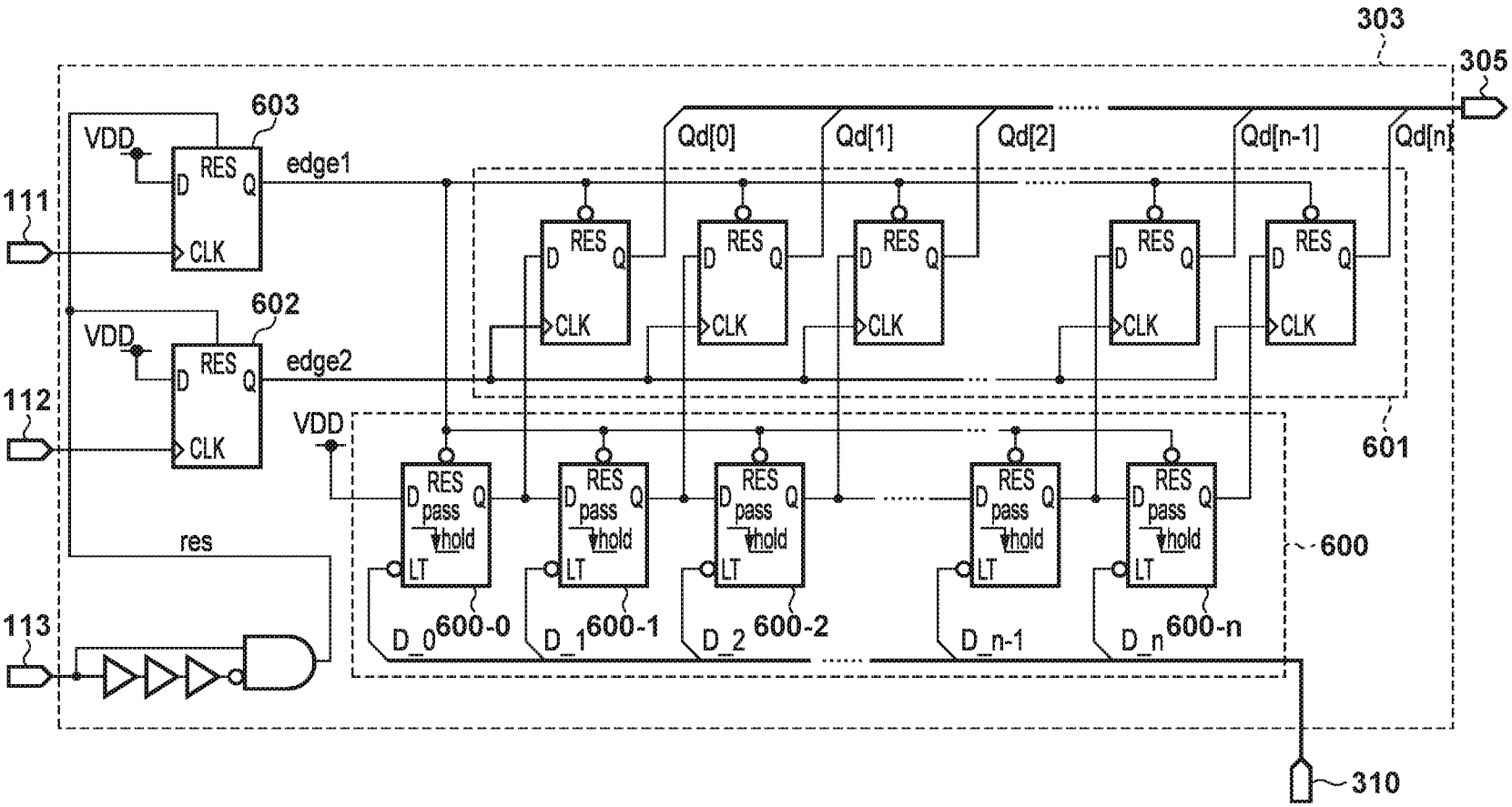
FIG. 8 is a diagram showing an example circuit of a first determination circuit according to the present invention.
Figure 10:
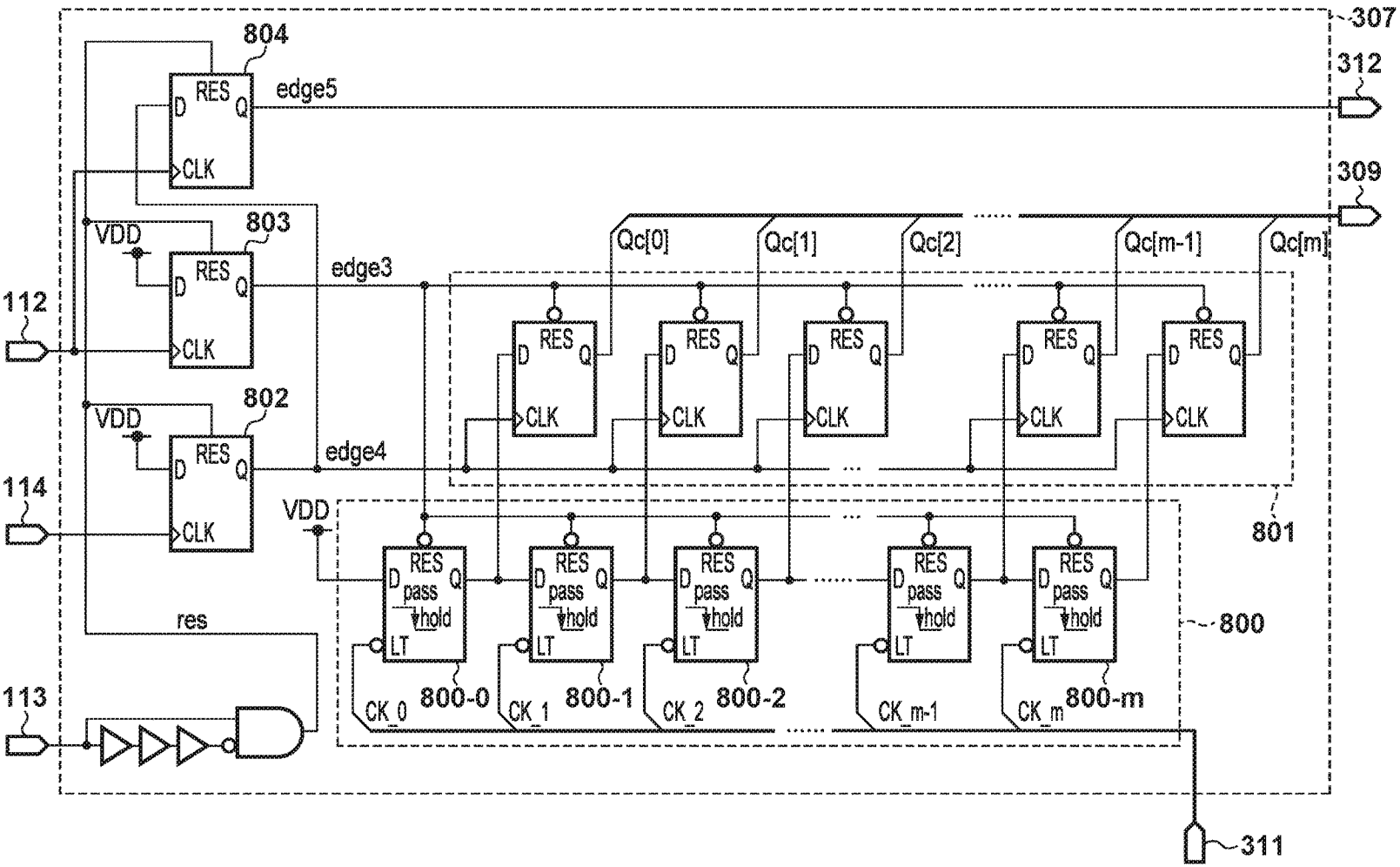
FIG. 10 is a diagram showing an example circuit of a second determination circuit according to the present invention.

FIG. 6 is a timing chart of the first signal correction circuit 300. FIG. 7 is a timing chart of the second signal correction circuit 301. FIG. 8 is a diagram showing an example circuit of the first determination circuit 303. FIG. 10 is a diagram showing an example circuit of the second determination circuit 307. Note that the first determination circuit 303 and the second determination circuit 307 according to this embodiment can be implemented using only digital circuits such as latch circuits, flip-flop circuits, etc.

Figure 9:
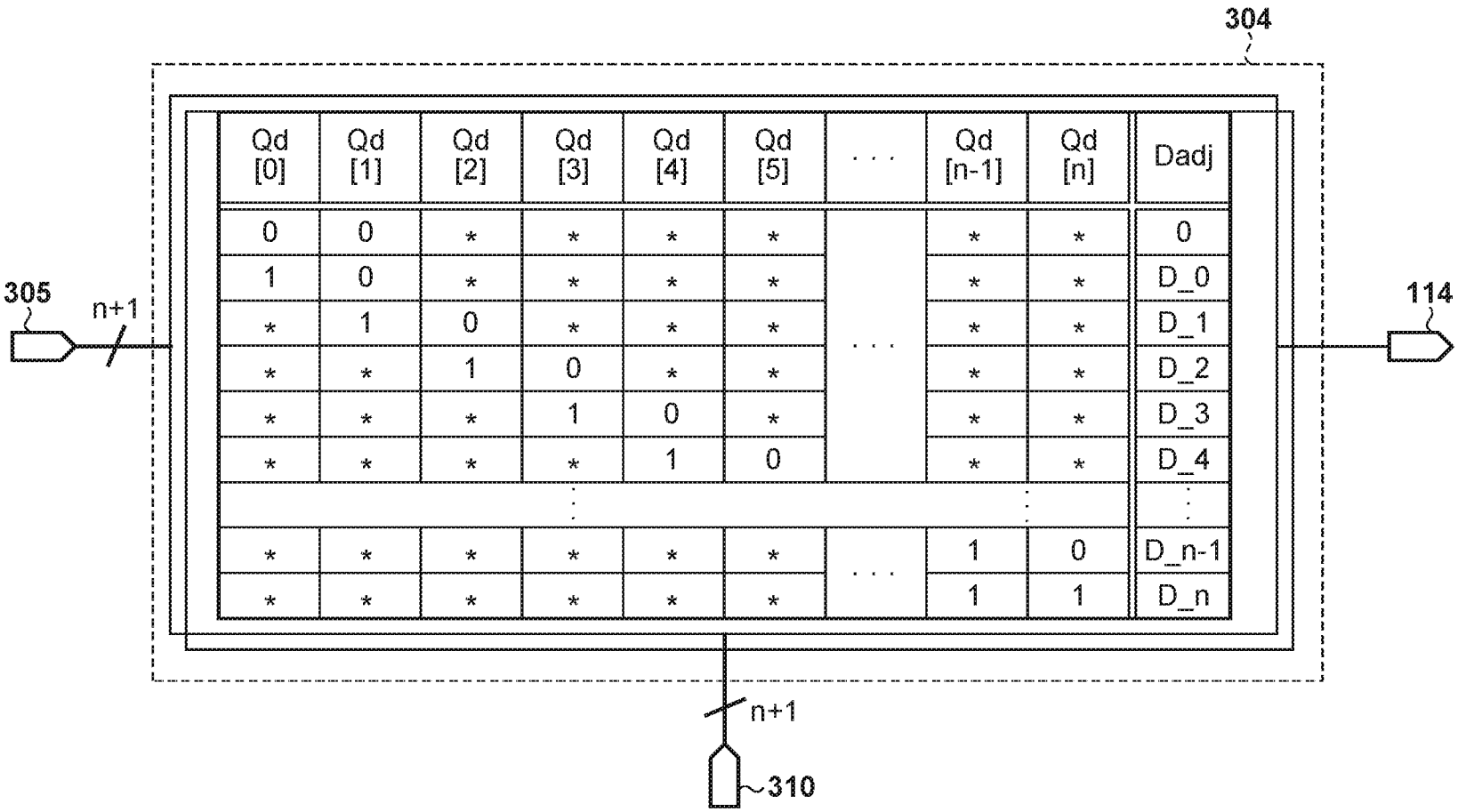
FIG. 9 is a diagram showing an example circuit of a first multiplexer according to the present invention.
Figure 11:
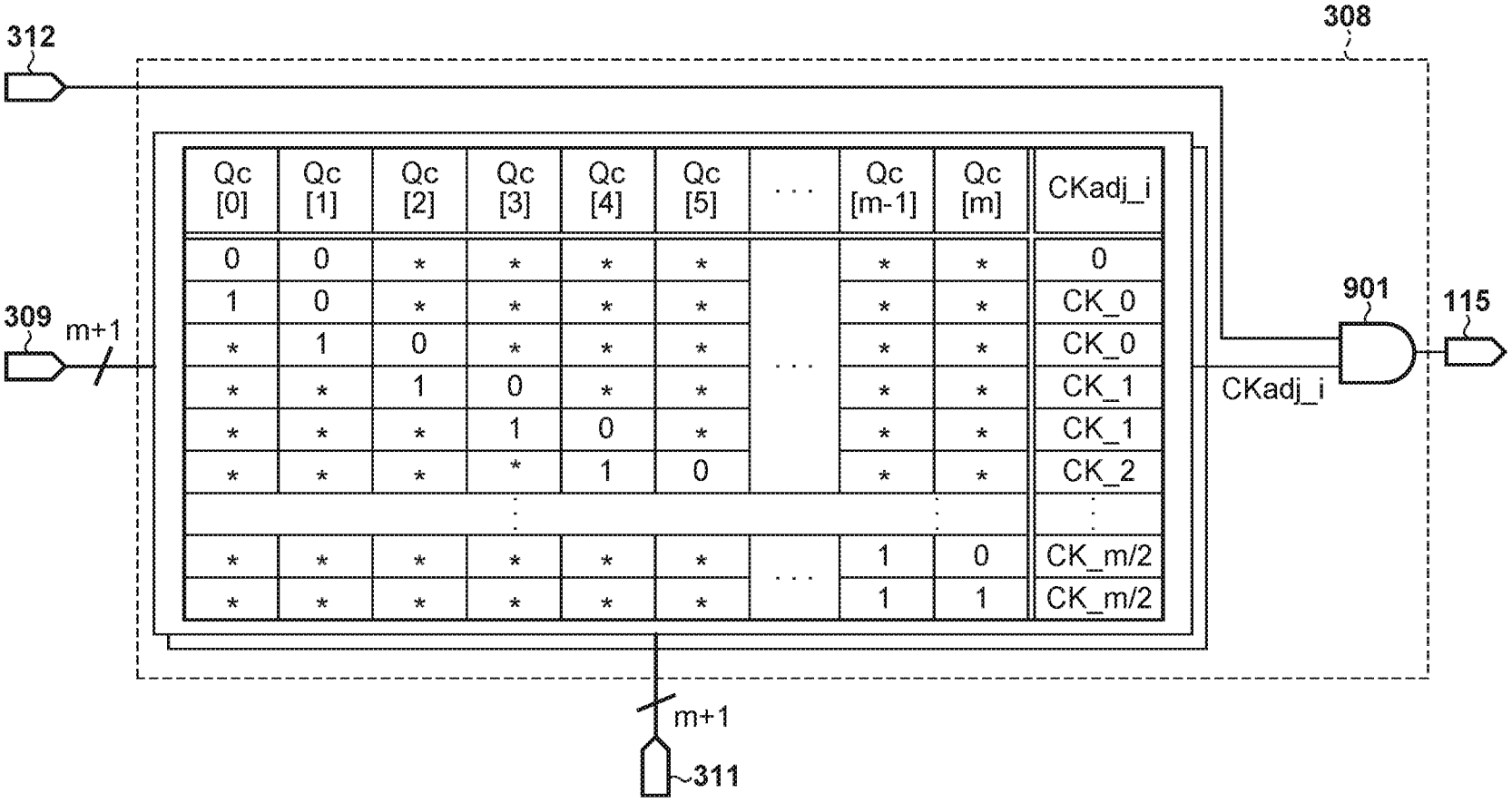
FIG. 11 is a diagram showing an example circuit of a second multiplexer according to the present invention.

FIG. 9 is a diagram showing a conceptual circuit configuration of the first multiplexer 304. The first multiplexer 304 selects one from the first delayed signals 310 (D_0, D_1, D_2, . . . , and D_n), on the basis of the first determination signal 305, according to a truth table shown in FIG. 9, and outputs the selected signal as the fourth signal 114 (Dadj). FIG. 11 is a diagram showing a conceptual circuit configuration of the second multiplexer 308. The second multiplexer 308 selects one from the second delayed signals 311 (CK_0, CK_1, CK_2, . . . , and CK_m), on the basis of the second determination signal 309, according to a truth table shown in FIG. 11, and outputs the selected signal as the fifth signal 115 (CKadj). Note that "*" shown in FIGS. 9 and 11 represents a "don't care" value. As described above, in FIG. 11, a half value of a corresponding delay time is output as CKadj_i. A logic shown in the truth table can be implemented using only digital circuits such as AND gates, CMOS switches, etc.

A detailed operation of the first signal correction circuit 300 will now be described with reference to FIGS. 6, 8, and 9. In the example of FIG. 6, the second signal 112 (CLK) is delayed from the first signal 111 (DATA) by a time "ts" with respect to a position "a" in an ideal state, resulting in a phase difference. In this example, it is assumed that the test flag signal 200 is a 2-bit signal "10." In the test flag signal 200, the first bit is 1 (high level), and the second bit is 0 (low level).

In FIG. 8, the first determination circuit 303 includes a plurality of latch circuits 600 (600-0 to 600-n), which receive the first delayed signals 310 as latch pulses. Therefore, the logical high level is transferred from the first latch circuit 600-0 to the following latch circuits 600-n in synchronization with the respective first delayed signals 310 (D_0, D_1, D_2, . . . , and D_n). Next, a flip-flop circuit 602 generates a signal edge2 that is synchronous with a rising of the second signal 112 (CLK), and the signal edge2 is input to a plurality of flip-flop circuits 601. The flip-flop circuits 601 output an (n+1)-bit first determination signal 305 (Qd) indicating how many latches the logical high level has been transferred through before the time of the rising of the signal edge2. A latch circuit 603 generates a signal edge1 on the basis of the third signal 113 (LT) and the first signal 111 (DATA). The signal edge1 is used as a reset signal for the latch circuits 600 and the flip-flop circuits 601.

In the example of FIG. 6, the zeroth to third bits of Qd have the high level, and the fourth and following bits of Qd have the low level, which indicates the high level has been transferred to the fourth latch circuit 600-3 that is driven according to the delayed signal D_3. This means that, of the first delayed signals 310, the delayed signal D_3 has a rising edge that coincides with a rising edge of the second signal 112 (CLK). The first multiplexer 304 of FIG. 9 outputs the delayed signal D_3 as the fourth signal 114 (Dadj) according to the first determination signal 305 (Qd) output from the first determination circuit 303.

Next, a detailed operation of the second signal correction circuit 301 will be described with reference to FIGS. 7, 10, and 11. In FIG. 10, the second determination circuit 307 includes a plurality of latch circuits 800 (800-0 to 800-m), which receive the second delayed signals 311 as latch pulses. Therefore, the logical high level is transferred from the first latch circuit 800-0 to the following latch circuits 800-m in synchronization with the respective second delayed signals 311 (CK_0, CK_1, CK_2, . . . , and CK_m). Next, a flip-flop circuit 802 generates a signal edge4 that is synchronous with a falling edge of the fourth signal 114 (Dadj), and the signal edge4 is input to a plurality of flip-flop circuits 801. The flip-flop circuits 801 output the second determination signal 309 (Qc) indicating how many latches the logical high level has been transferred through before the time of the rising of the signal edge4. A signal edge5, which is obtained by taking in the signal edge4 at a rising edge of CLK, is generated by a flip-flop circuit 804. The signal edge5 is supplied to the second multiplexer 308, and is used as a masking signal 312. A signal edge3 is generated by a flip-flop circuit 803 on the basis of the third signal 113 (LT) and the second signal 112 (CLK), and is used as a reset signal for the latch circuits 800 and the flip-flop circuits 801.

In the example of FIG. 7, the zeroth to fourth bits of Qc have the high level, and the fifth and following bits of Qc have the low level, which indicates that the high level has been transferred to the fifth latch circuit 800-4 that is driven according to the delayed signal CK_4. This means that the delayed signal CK_4 has a rising edge that coincides with a falling edge of the fourth signal 114 (Dadj). The second multiplexer 308 of FIG. 11 selects the delayed signal CK_2 having half the delay time of the delayed signal CK_4, according to the second determination signal 309 (Qc). Thereafter, the second multiplexer 308 masks an unnecessary portion of the selected delayed signal by an AND gate 901 using the signal edge5 (masking signal 312), and outputs the resultant signal as the fifth signal 115 (CKadj). As a result, the clock signal is corrected by the time "ts," so that the edge of the clock signal is returned to the ideal position "a," and therefore, the clock signal is reliably synchronized with the data signal. Note that, as described above, in another embodiment, the second multiplexer 308 may select the delayed signal CK_3 that has a smaller delay time than that of the delayed signal CK_4.

According to the above configuration, in the printing apparatus of this embodiment, a training period for stabilizing the operation of a circuit is not required, and the phase difference can be instantaneously corrected. In addition, by performing the phase correction on a regular basis (e.g., for each latch time), phase changes caused by changes in temperature or changes over time can be followed, and therefore, reliability can be ensured.

In addition, as described above, the correction circuit according to the present invention does not require a capacitor which is required in an analog circuit such as a DLL circuit or a PLL circuit. A considerably large area is required to provide a capacitor in a substrate. The correction circuit according to the present invention includes only digital circuits, as described above, and therefore, the area can be saved.

In addition, since the correction circuit according to the present invention can be implemented using only digital circuits, the correction circuit is highly resistant to noise, compared to conventional techniques that employ analog circuits such as DLL circuits, PLL circuits, etc. In particular, on printing element substrates, when a printing element is driven, a current of the order of amperes instantaneously flows, so that much electromagnetic noise occurs. Therefore, the correction circuit according to the present invention is suitable for printing element substrates.

Variation 1 of First Embodiment

In the first embodiment described above, as shown in FIG. 5, the first determination circuit 303 checks the (n+1) first delayed signals 310, and outputs the first determination signal 305. In Variation 1 of the first embodiment, the first determination circuit 303 may additionally check the first signal 111 (DATA). In this configuration, the first multiplexer 304 selects one from (n+2) signals (i.e., the first delayed signals 310 and the first signal 111), and outputs the selected signal as the fourth signal 114 (Dadj). Therefore, in Variation 1 of the first embodiment, when a rising edge of the first signal 111 (DATA) coincides a rising edge of the second signal 112 (CLK), the first signal 111 (DATA) is output as the fourth signal 114 (Dadj). Note that the other circuit configuration is the same as that of the first embodiment and therefore will not be described.

Variation 2 of First Embodiment

Variation 2 of the first embodiment is the same as Variation 1 of the first embodiment, except that the first delay circuit 302 generates a single first delayed signal 310. This configuration can reduce the circuit scale of the first signal correction circuit. In this configuration, the first determination circuit 303 checks a total of two signals, i.e., the first signal 111 (DATA) and the single first delayed signal 310. The first multiplexer 304 selects one of the two signals, and outputs the selected signal as the fourth signal 114 (Dadj). The other configuration is the same as that of Variation 1 of the first embodiment and therefore will not be described.

Second Embodiment

Figure 12:
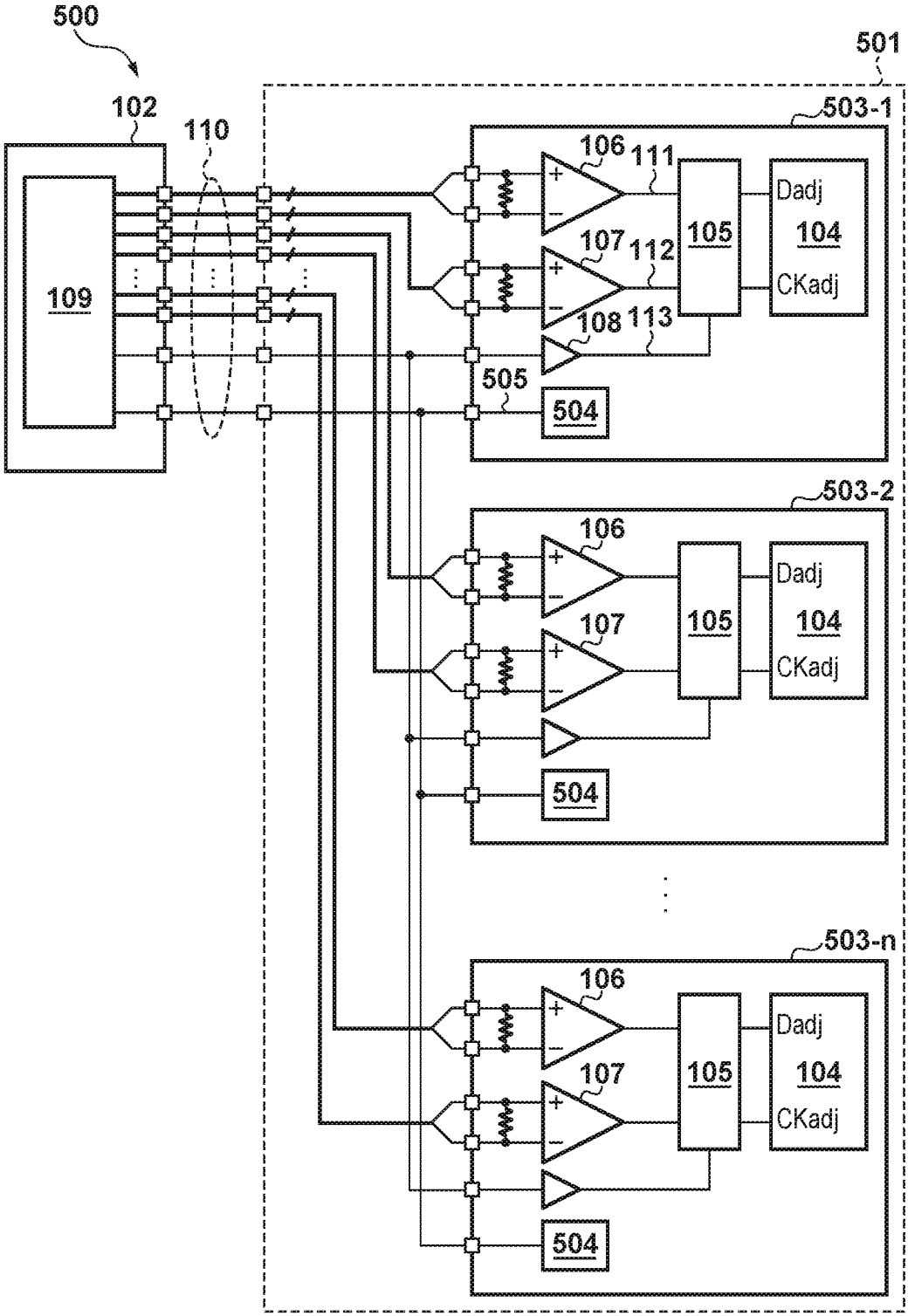
FIG. 12 is a diagram showing an example configuration of a printing apparatus according to a second embodiment.

FIG. 12 is a diagram schematically showing a printing apparatus 500 according to a second embodiment of the present invention. The printing apparatus 500 according to the second embodiment is different from the printing apparatus 100 according to the first embodiment in that printing element substrates 503 each include a temperature detection unit 504. The temperature detection unit 504 outputs a temperature detection signal 505 corresponding to temperature to the head control IC 109 provided in the main-body substrate 102 of the printing apparatus through the transmission line path 110. The head control IC 109 reads (samples) the temperature detection signal 505 to find a temperature state of the printing element substrate 503, and on the basis of the temperature state, controls a printhead 501, such as changing conditions (a driving voltage or a driving pulse) for driving a printing element, etc.

As in the first embodiment, the correction circuit 105 corrects the phase difference between the first signal 111

(DATA) and the second signal 112 (CLK), to output the fourth signal 114 (Dadj) and the fifth signal 115 (CKadj). The operation of the correction circuit 105 is similar to that of the first embodiment and therefore will not be described in detail.

It has been known that the amount of ink discharged by a printing element substrate increases with an increase in temperature. Despite this, inkjet printing apparatuses are required to achieve the reproducibility and color stability of a printed image even during continuous printing. Conventional techniques have been disclosed for precisely controlling a driving voltage and a driving pulse for a printhead even during continuous printing. According to such conventional techniques, conditions (a driving voltage and a driving pulse) for driving a printing element are adjusted by a signal processing circuit in a printing apparatus on the basis of temperature data detected by a temperature detection element included in a printing element substrate, to perform control so as to become the amount of discharged ink uniformly.

For example, a diode may be used as the temperature detection unit 504. In this case, it is necessary to detect a very small change in voltage depending on the temperature characteristics (−2 mV/° C.) of the forward bias of the p-n junction. However, in the printing element substrate 503, digital signals such as an image data signal, a clock signal, etc., are supplied adjacent to the temperature detection signal 505, and noise from the digital signals is superposed on the temperature detection signal 505, and therefore, an error occurs in detected temperature.

To address this, in the printing apparatus 500 of this embodiment, a pause period during which the logic of a digital signal does not transition is provided, and the temperature detection signal 505 free from superposed noise is read during the pause period. As a result, in this embodiment, the temperature of the printing element substrate 503 can be accurately detected.

Figure 13:
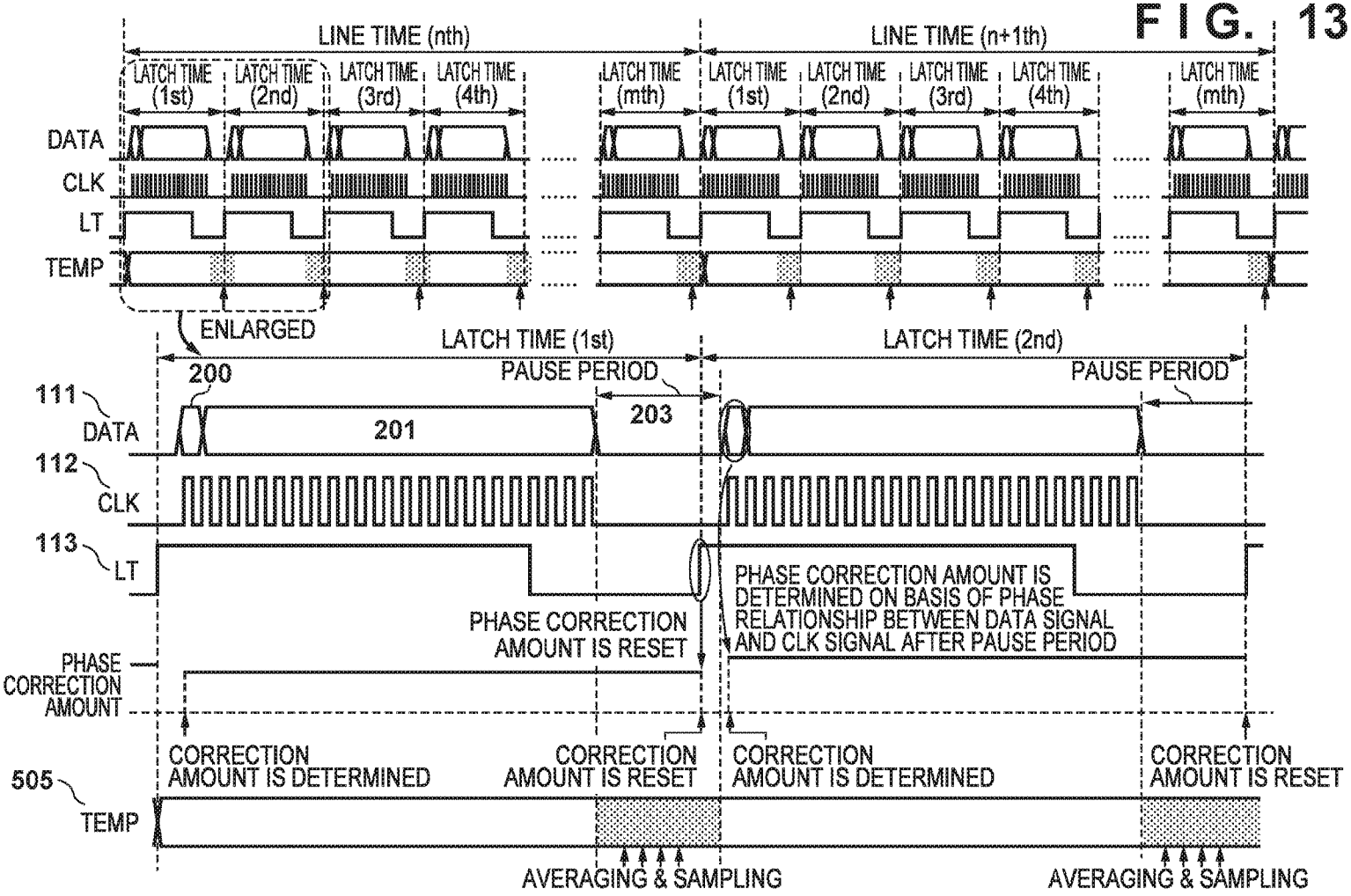
FIG. 13 is a timing chart of the printing apparatus according to the second embodiment.

FIG. 13 is a timing chart of the printing apparatus 500 according to this embodiment. The temperature detection signal 505 is represented by TEMP. The head control IC 109 reads the temperature detection signal 505 (TEMP) as obtained during the pause period 203, to find a temperature state of the printing element substrate 503. Here, it is assumed that the temperature detection signal 505 is read (sampled) a certain number of times during the pause period 203, and an average value thereof is used. Here, the number of times the temperature detection signal 505 is read may be determined on the basis of the length of the pause period 203, or may be previously determined.

During the pause period 203, the logic of a digital signal such as an image data signal (DATA), a clock signal (CLK), etc. does not transition, and therefore, the temperature detection signal 505 is not affected by crosstalk noise. Therefore, the head control IC 109 can find the correct temperature of the printing element substrate 503.

The phase difference between the first signal 111 (DATA) and the second signal 112 (CLK) is corrected after the pause period 203, and therefore, the temperature detection signal 505 is not affected by noise that is caused, through a power supply, by the correction circuit 105 operating at high speed.

According to the above configuration, the printing apparatus according to this embodiment does not require a training period, and can instantaneously correct the phase difference between an image data signal (DATA) and a clock signal (CLK). As a result, an image data signal and a clock signal can be paused on a regular basis. By reading the temperature detection signal during this pause period, a temperature state of a printing element substrate can be accurately found without being affected by crosstalk of a data signal or a clock signal, resulting in high reliability.

Other Embodiments

In the foregoing, the first and second embodiments have been described. The present invention is not limited to these embodiments. For example, although the correction circuit 105 is provided together with the driving circuit 104 on the printing element substrate 103, the correction circuit 105 may be provided on a different substrate provided in the printhead 101. For example, although the frequency of the phase correction in the above embodiments is once a latch time, the present invention is not limited to this. The frequency of the phase correction may be two a latch time, four a latch time, or once a line time.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-189918, filed Sep. 28, 2016, which is hereby incorporated by reference herein in its entirety.

What is claimed is:

1. A printing element substrate comprising:

a printing element;

a driving circuit configured to drive the printing element;

a receiver circuit configured to receive a first signal and a second signal; and a correction circuit configured to correct a phase difference between the first signal and the second signal received by the receiver circuit, and output the corrected first and second signals to the driving circuit, wherein the correction circuit includes a first delay circuit configured to generate a plurality of first delayed signals having different delay times with respect to the first signal, and a second delay circuit configured to generate a plurality of second delayed signals having different delay times with respect to the second signal, the correction circuit specifies a phase of the corrected first signal to be output to the driving circuit, on the basis of comparison between the plurality of first delayed signals and the second signal, and the correction circuit specifies a phase of the corrected second signal to be output to the driving circuit, on the basis of comparison between the plurality of second delayed signals and the corrected first signal having the specified phase.

2. The printing element substrate according to claim 1, wherein the correction circuit includes a first determination circuit configured to specify one of the plurality of first delayed signals, the one having a rising edge coinciding with a rising edge of the second signal, as the phase of the corrected first signal to be output to the driving circuit, and a second determination circuit configured to specify the phase of the corrected second signal to be output to the driving circuit, on the basis of one of the plurality of second delayed signals, the one having a rising edge coinciding with a falling edge of the corrected first signal specified by the first determination circuit.

3. The printing element substrate according to claim 2, further comprising:

a first selection circuit configured to select one of the plurality of first delayed signals, the one having the phase specified by the first determination circuit, as the corrected first signal to be output to the driving circuit; and a second selection circuit configured to select one of the plurality of second delayed signals, the one having a delay time smaller than a delay time corresponding to the phase specified by the second determination circuit, as the corrected second signal to be output to the driving circuit.

4. The printing element substrate according to claim 1, wherein the first signal is a data signal, and the second signal is a clock signal.

5. The printing element substrate according to claim 1, wherein the receiver circuit receives a third signal, and the correction circuit corrects the phase difference for each period of the third signal.

6. The printing element substrate according to claim 5, wherein the third signal is generated with reference to a line time, and the line time is a period of time it takes to print a column line or a row line on a printing medium.

7. The printing element substrate according to claim 5, wherein the third signal is generated with reference to a latch time, and the latch time is a period of time corresponding to a block, where a line time it takes to print a column line or a row line on a printing medium is divided into a plurality of the blocks for time-division driving.

8. The printing element substrate according to claim 1, wherein a pause period during which neither a logic of the first signal nor a logic of the second signal transitions, is provided on a regular basis, and the correction circuit corrects the phase difference between the first signal and the second signal, on the basis of a phase relationship between the first signal and the second signal after the pause period.

9. The printing element substrate according to claim 8, further comprising:

a temperature detection unit configured to output a temperature detection signal corresponding to temperature, wherein during the pause period, the temperature detection signal output by the temperature detection unit is read.

10. A printhead comprising:

a plurality of printing element substrates, wherein each printing element substrate includes a printing element, a driving circuit configured to drive the printing element, a receiver circuit configured to receive a first signal and a second signal, and a correction circuit configured to correct a phase difference between the first signal and the second signal received by the receiver circuit, and output the corrected first and second signals to the driving circuit, the correction circuit includes a first delay circuit configured to generate a plurality of first delayed signals having different delay times with respect to the first signal, and a second delay circuit configured to generate a plurality of second delayed signals having different delay times with respect to the second signal, the correction circuit specifies a phase of the corrected first signal to be output to the driving circuit, on the basis of comparison between the plurality of first delayed signals and the second signal, and the correction circuit specifies a phase of the corrected second signal to be output to the driving circuit, on the basis of comparison between the plurality of second delayed signals and the corrected first signal having the specified phase.

11. The printhead according to claim 10, wherein the printhead is a full-line printhead.

12. A printing apparatus comprising:

a printhead including a plurality of printing element substrates, wherein each printing element substrate includes a printing element, a driving circuit configured to drive the printing element, a receiver circuit configured to receive a first signal and a second signal, and a correction circuit configured to correct a phase difference between the first signal and the second signal received by the receiver circuit, and output the corrected first and second signals to the driving circuit, the correction circuit includes a first delay circuit configured to generate a plurality of first delayed signals having different delay times with respect to the first signal, and a second delay circuit configured to generate a plurality of second delayed signals having different delay times with respect to the second signal, the correction circuit specifies a phase of the corrected first signal to be output to the driving circuit, on the basis of comparison between the plurality of first delayed signals and the second signal, and the correction circuit specifies a phase of the corrected second signal to be output to the driving circuit, on the basis of comparison between the plurality of second delayed signals and the corrected first signal having the specified phase.

* * * * *